US005421472A

United States Patent [19]

Beckertgis

[11] Patent Number: 5,421,472

[45] **Date of Patent: * Jun. 6, 1995**

[54] INSECT-PROOF AND TAMPER-EVIDENT COVER FOR BEVERAGE CONTAINER

[76] Inventor: Nicholas G. Beckertgis, 1320 N. 4th St., Sheboygan, Wis. 53081

[ * ] Notice: The portion of the term of this patent subsequent to Dec. 14, 2010 has been disclaimed.

[21] Appl. No.: 166,573

[22] Filed: Dec. 13, 1993

Related U.S. Application Data

[63] Continuation-in-part of Ser. No. 049,764, Apr. 19, 1993, Pat. No. 5,269,432.

[51] Int. Cl.[6] ..... B65D 51/18

[52] U.S. Cl. ..... 220/253; 222/481; 222/548; 222/565

[58] Field of Search ..... 220/253, 256, 258, 259, 220/336; 222/480, 481, 482, 486, 548, 565

[56] References Cited

U.S. PATENT DOCUMENTS

| | | | |
|---|---|---|---|
| 3,388,841 | 6/1968 | McHardy et al. | 222/548 |
| 5,213,238 | 5/1993 | Martin et al. | 222/480 |
| 5,269,432 | 12/1993 | Beckertgis | 220/253 |

*Primary Examiner*—Allan N. Shoap
*Assistant Examiner*—Nova Stucker
*Attorney, Agent, or Firm*—Francis J. Bouda

[57] ABSTRACT

An insect-proof and tamper-evident cover is disclosed for a disposable, metal, one-time use beverage container. A lid, non-rotatably secured to the upper end of the beverage container, includes an opening with bars formed there-across, and with a plurality of cover-supporting bumps and a position-controlling groove. A rotatable cover is secured to said lid in a fluid-tight arrangement. The cover includes an opening with bars there-across, at least one finger-engaging member, a tamper-evident indicator, and a projection arranged to travel in the position-controlling groove of the lid.

5 Claims, 3 Drawing Sheets

INSECT-PROOF AND TAMPER-EVIDENT COVER FOR BEVERAGE CONTAINER

This is a continuation-in-part application of patent application Ser. No. 08/049,764, filed Apr. 19, 1993 now U.S. Pat. No. 5,269,432.

BACKGROUND OF THE INVENTION

It is well-known in the art of beverage containers to provide soft drink cans and beer cans with metal tops, and these usually have a pull-ring device by which the user of the can gains access to the contents. The pull-ring is generally disposed or, in some cases, can be bent inwardly into the can so as to provide a fluid-accessible opening. Unfortunately, when such a container is opened and the contents partially consumed, quite often bees, wasps, mosquitoes, flies or other insects are attracted to the sugar-sweet contents and enter the container unnoticed. Thereafter, when the contents are consumed, the user quite often swallows and is injured by the insects. In the United States, several hundreds of deaths each year are occasioned by the stings of bees or wasps which have been swallowed while drinking the contents of such a beverage container.

Furthermore, it has long been known to provide a container for condiments, such as spices, salt, sugar or the like, with a 2-piece cover or cap arranged so that one portion acts as a closure and the other portion acts as a spout. When the two elements are in one position, the openings are covered by portions of the closure, and when the closure is rotated, the openings are exposed and the contents can be dispensed.

The prior art in this field of closures or covers for beverage containers or devices to protect the contents, including devices to prevent access to the interior by insects or the like, are shown in the following patents:

| | | |
|---|---|---|
| Thorn | U.S. Pat. No. 2,121,554 | 06/21/1938 |
| Rivas | U.S. Pat. No. 3,160,309 | 12/08/1964 |
| Gentile | U.S. Pat. No. 3,726,432 | 04/10/1973 |
| Morehead | U.S. Pat. No. 4,537,326 | 08/27/1985 |
| Kacalieff | U.S. Pat. No. 4,611,725 | 09/16/1986 |
| Ayyoubi | U.S. Pat. No. 4,717,039 | 01/05/1988 |
| Gabrys | U.S. Pat. No. 4,846,374 | 07/11/1989 |
| Dimberio | U.S. Pat. No. 4,852,763 | 08/01/1989 |
| Cerrone | U.S. Pat. No. 4,869,389 | 09/26/1989 |
| Englert | U.S. Pat. No. 4,880,136 | 11/14/1989 |
| Hall | U.S. Pat. No. 4,901,877 | 02/20/1990 |
| Thibeqault | U.S. Pat. No. 4,930,654 | 06/05/1990 |
| Levine | U.S. Pat. No. 4,979,635 | 12/25/1990 |
| Tucker | U.S. Pat. No. 5,125,525 | 06/30/1992 |
| Kick | U.S. Pat. No. 5,167,338 | 12/01/1992 |

Of these, the most relevant, because they refer to the prior art relating to insect-preventing closures are Morehead 4,537,326; Cerrone 4,869,389; Hall 4,901,877 and Tucker 5,125,525.

While all of these devices have merit, they have distinguishing features which make them either economically or commercially unsatisfactory and, more particularly, difficult for the consumer to use.

Thus the prior art fails to disclose the protective closure of the present invention, which can be easily and simply operated by the consumer, which assures the sanity of the contents while yet permitting easy removal thereof, which also provides for protection against access to the interior of the container by unwanted insects, which includes a tamper-evident device, and which can be manufactured economically so that such device can be discarded along with the used container.

OBJECTS OF THE INVENTION

One object of the present invention is to provide a tamper-evident and insect-proof cover for disposable metal beverage containers.

A further object of the present invention is to provide a closure for a beverage container which not only serves as an insect-preventing device, but also permits use and re-use of the container while the contents are intermittently consumed.

Still a further object of the present invention is to provide a tamper-evident re-closable insect-proof cover for a beverage container, which can be easily operated by one hand.

SUMMARY OF THE INVENTION

The present invention relates to a metal beverage container, such as soft drink containers, beer cans, fruit and vegetable cans, and the like and, more particularly, for a permanently attached rotatable cover for such can for preventing insects from getting into the can.

The cover includes a circular or disc-shaped lid which is permanently and non-rotatably seamed to the top edge of the can in a fluid-tight and air-tight manner. This portion has an opening therein with a number of parallel strips extending across the opening, relatively close to each other. Affixed to the lid is a rotatable cover which has an opening therein similar in shape to the opening in the lid, and which cover-opening also has parallel strips across the opening. When the opening in the lid and the opening in the cover are in alignment, the strips on one are disposed at right angles to the strips on the other. With the cover-opening rotated into alignment with the opening in the lid, the contents can flow therethrough, but very small insects cannot gain access past the screen to the interior of the container. The assembly is also provided with a means to limit the amount of rotation of the cover with respect to the lid, and a tamper-indicating arrangement to advise the user whether the can has been previously opened.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described:

In the drawings, wherein like reference characters indicate like parts:

Figure 1:
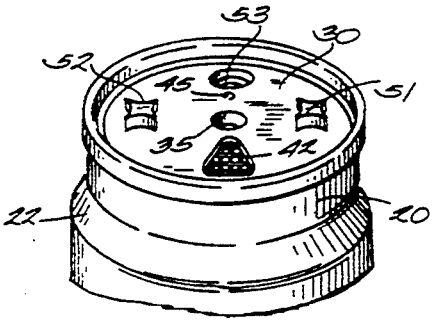
FIG. 1 is a perspective view of a beverage container with one embodiment of a closure of the present invention attached thereto.
Figure 2:
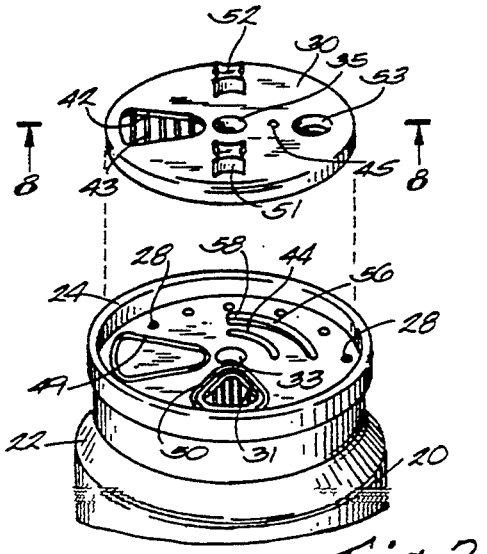
FIG. 2 is a perspective view similar to FIG. 1, but showing the closure displaced from the lid of the container.

Referring now to FIG. 1 there is shown a metal beverage container 20, the upper end 21 of which is of a smaller diameter than the body of the container with the sloping portion 22 being disposed intermediate the body of the container and the upper end 21.

Figure 4:
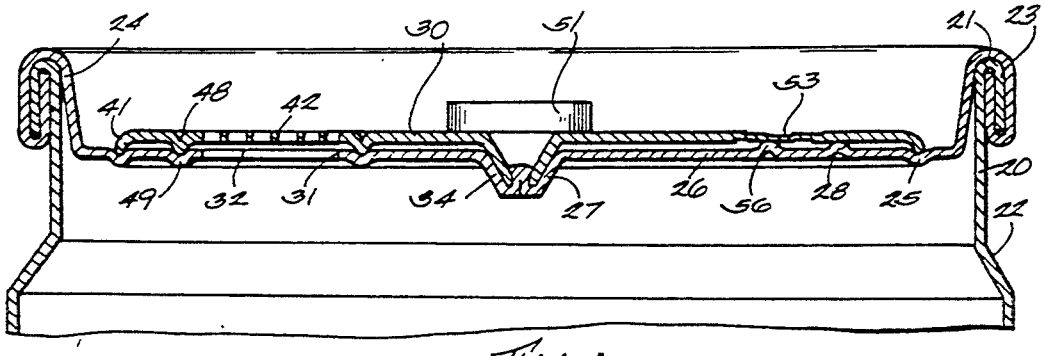
FIG. 4 is a vertical cross-sectional view of a beverage container with the protective closure of FIG. 1 of the present invention attached thereto, taken generally along lines 4—4 of FIG. 3.
Figure 7:
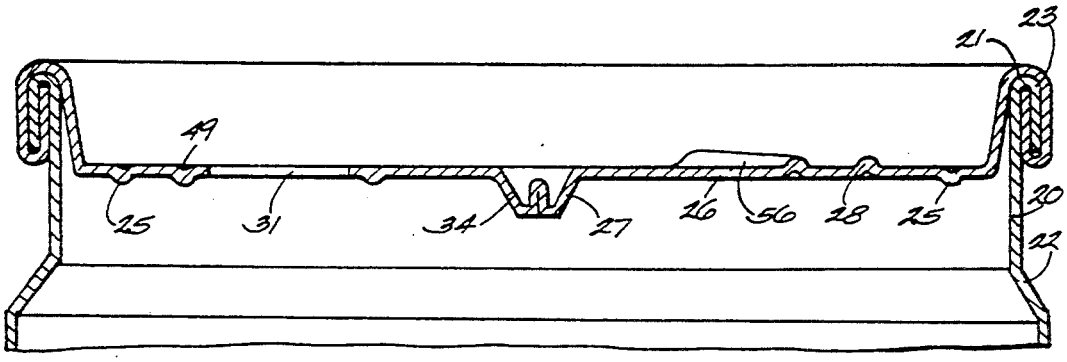
FIG. 7 is a vertical cross-sectional view taken generally along line 7—7 of FIG. 5.

As can be seen particularly in FIGS. 4 and 7, the upper end 21 has a double-crimp inter-connection with the flange 23 of a top lid 24.

The lid 24 is tightly sealed to the upper end 21 of the body of the container, so as to provide an air-tight and fluid-tight connection.

The lid 24, which is non-rotatably fixed to the body of the can, generally includes a circular groove 25 which extends around the periphery of the lid 24.

For the most part, the lid 24 is generally flat as at 26, with a pivot-portion 27 in the center and a plurality of raised portions 28 disposed between the central portion 27 and the peripheral groove 25.

Figure 5:
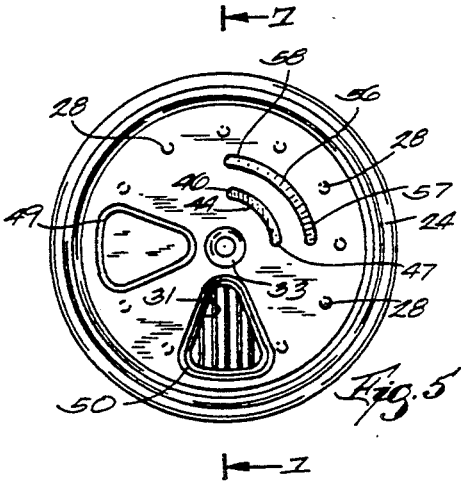
FIG. 5 is a top plan view of the non-rotatable lid-portion of the closure of FIG. 1 of the present invention securely fixed to the top of the beverage container.

The raised portions 28 are hemispherically shaped bumps as shown in FIGS. 4 and 5. These hemispherical portions 28 provide contact points on which the rotatable cover 30 can rest to provide an easier sliding movement between the cover 30 and the lid 24.

The lid 24 has a generally triangular opening 31 formed therein with a plurality of strips or metal strands 32 disposed across the opening 31, for a purpose to be hereinafter described.

Figure 12:
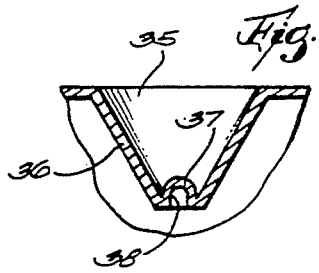
FIG. 12 is an enlarged view of the central pivot-portion of the rotatable cover member of FIG. 1.
Figure 11:
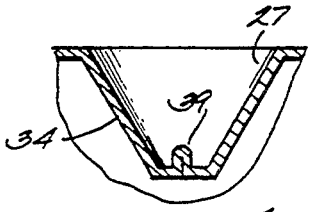
FIG. 11 is an enlarged view of the central pivot-portion of the non-rotatable lid member of FIG. 1.

As shown more clearly in FIGS. 11 and 12, the pivot 27 at the center 33 of the lid 24 has a cone shaped depression 34 which provides an axis around which the cover 30 can rotate, inasmuch as the cover 30 has a center 35 which is generally a cone shaped depression 36 which nests into the depression 34. The bottom of the depression 34 has an upstanding portion 37 which fits into the recess 38 in the portion 39 of the cover 30. By appropriate arrangement of the members 37 and 39, as by a snap ring or by peening the ends or similar means of attachment, the cover 30 is rotatably secured to the lid 24. This inter-engagement between the lid 24 and the cover 30 can best be seen in FIG. 4. The underside of the cover 30 can be coated with a plastic or similar sealing material, which insures that no leakage takes place, and this provides for an air-tight and fluid-tight inter-connection between the cover and the lid.

Figure 8:
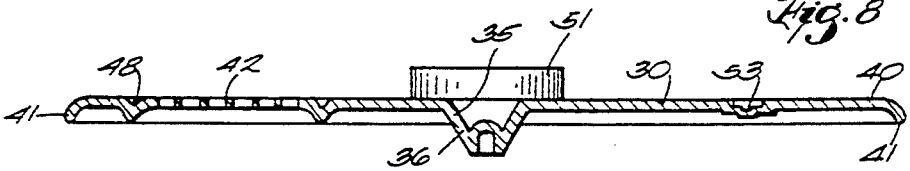
FIG. 8 is a vertical cross-sectional view taken generally along line 8—8 of FIG. 1.

As shown particularly in FIG. 8, the outer edge of the cover 30 has a curved portion 40 ending in a rim 41 which rides in the peripheral groove 25 to provide a seal which prevents contamination of the operative members located centrally of the groove 25.

The cover 30 also has a generally triangular shaped opening 42 formed therein, quite similar in shape and outline to the opening 31 in the lid 29, but in this case the strips or bars 43 are disposed generally at right angles to a radius (as contrasted to the bars 32 in the lid-opening 31 where the bars are disposed generally parallel to a radius).

Figure 3:
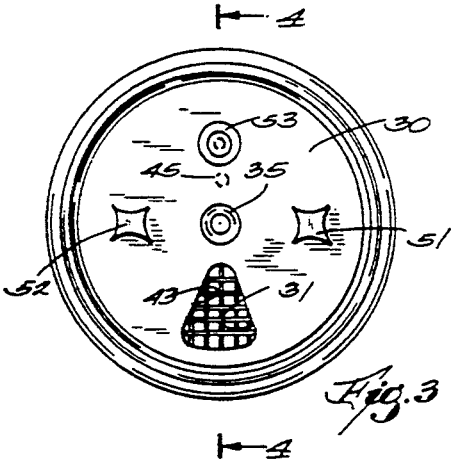
FIG. 3 is a top plan view of the closure of FIG. 1 of the present invention assembled on a beverage container.

As can best be seen in FIG. 3, this arrangement provides for an overlapping of the bars 32 and the bars 43, and, therefore, they form a screen of very small apertures or openings, sufficient to permit the passage of the fluid contents from the container, but yet preventing the entry into the container of any small insects.

In FIG. 4, I have shown how a portion of the cover 30 rides on top of the hemispherical bumps 28 in the lid 24.

Referring now to FIG. 5, there is shown a arcuate groove 44 which is formed in the lid 24. This arcuate groove provides a track in which a projection 45 of the cover 30 can ride between an "open" position 46 and a closed position 47. Each of the positions 46 and 47 have a further depression in addition to the groove 45 to provide a "stop" to indicate to the user that the rotatable cover 30 is in either the open or the closed position with respect to the lid 24.

Around the periphery of the opening 42, on the underside of the cover 30 a continuous male rib 48 is formed, designed to nest in a mating female groove 49 disposed around the periphery of the opening 31 in the lid 24. This inter-engaging and mating arrangement of rib 48 and groove 49 serves to provide a seal around the edges of the openings 31 and 42 when the two openings are in operative alignment.

A similar female groove or depression 50, identical in outline to the male rib 48 is formed in the surface of the lid 24 and the rib 48 rests in this depression when the lid and cover are in a closed relation, thus sealing the two members against passage of fluid therebetween when the container is closed.

Additionally, I have provided on the upper surface of the cover 30 a pair of finger-engaging members 51 and 52. These members are formed in a plurality of arcs and placed on the cover 30 in such a way that the thumb and forefinger of the user can rest against one or the other sides of these members to assist in turning the rotatable cover 30 with respect to the non-rotatable lid 24.

Having thus described the details of the lid 24 and the cover 30, one can see with reference to FIG. 4 that the two closure members (lid 24 and cover 30) are interconnected at the central pivots, and by the inter-engagement of the rib 48 with the depressions 49 or 50 provide the air-tight and fluid-tight assembly between cover and lid. When the cover is in the position gener-ally shown in FIG. 3, the access to the container (or conversely the port through which the fluid can be consumed) by any unwanted insect, is prevented by the screen formed by the strips 32 and 37. In this position the rib 48 is nesting in the depression 49.

However, when the cover is turned (by the user of the container twisting the cover by pressing against the finger-grips 51 and 52), it rotates with the projection 45 riding in groove or track 44, until the projection 45 moves from the position 46 in the lid 24 to the position 47 in the lid 24. This is the closed portion, and the rib 48 is nesting in the depression 50.

Figure 6:
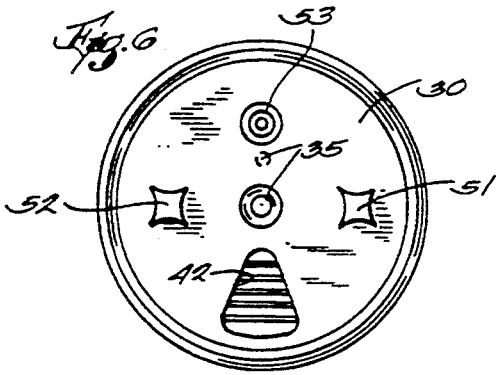
FIG. 6 is a top plan view of the rotatable cover-portion of FIG. 1 of the closure of the present invention.

To open the container, the cover is turned counter-clockwise (when viewed in FIGS. 3, 5 and 6) so that the projection 45 moves from the position 47 to the position 46 in FIG. 5.

Figure 9:
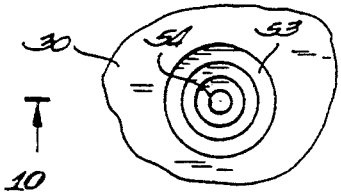
FIG. 9 is a top plan view of the tamper-evident embossment in the cover member of FIG. 1.
Figure 10:
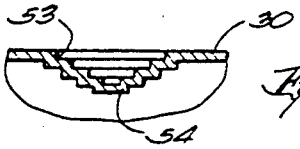
FIG. 10 is a vertical cross-sectional view taken generally along line 10—10 of FIG. 9.

The unique tamper-evident arrangement is best seen in FIGS. 9 and 10. A depression 53 is formed in the cover 30 in a manner to provide the pleated or folded or stepped configuration to form a type of bellows with a small round tip 54 at its center. When in the initial closed position of the container (as when shipped from the factory of the filler of the can) the tip 54 is in a depression 55. When the container is first opened, the tip 54 rides on an inclined ridge 56 from position 57 to position 58, and when doing so, the bellows are collapsed toward the upper surface of the cover 30, indicating that the can has been opened. Thus the user of the container can visually detect if contamination or use of the container has taken place.

Referring now to FIGS. 13–17, there is shown a preferred embodiment of the invention which provides fluid-tight seal between the lid and the cover even when the pressure in the container exceeds 90 pounds per square inch (psi).

Figure 13:
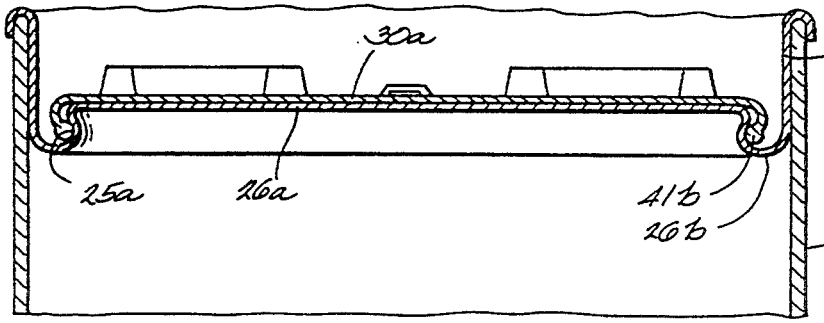
FIG. 13 is a vertical cross-sectional view of another embodiment of the beverage container of the present invention.
Figure 15:
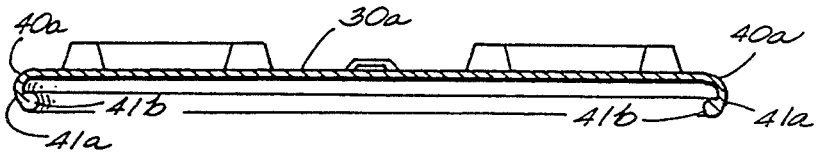
FIG. 15 is a vertical cross-sectional view of the cover of the embodiment shown in FIG. 13.
Figure 14:
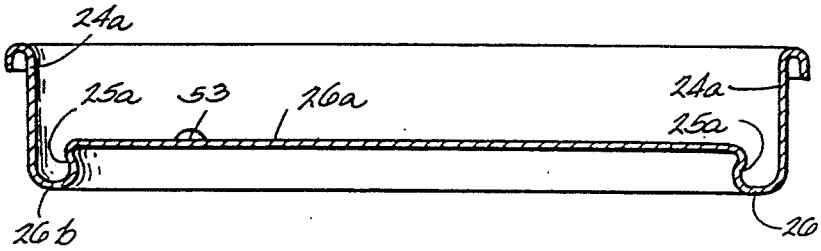
FIG. 14 is a vertical cross-sectional view of the lid of the embodiment shown in FIG. 13.
Figure 16:
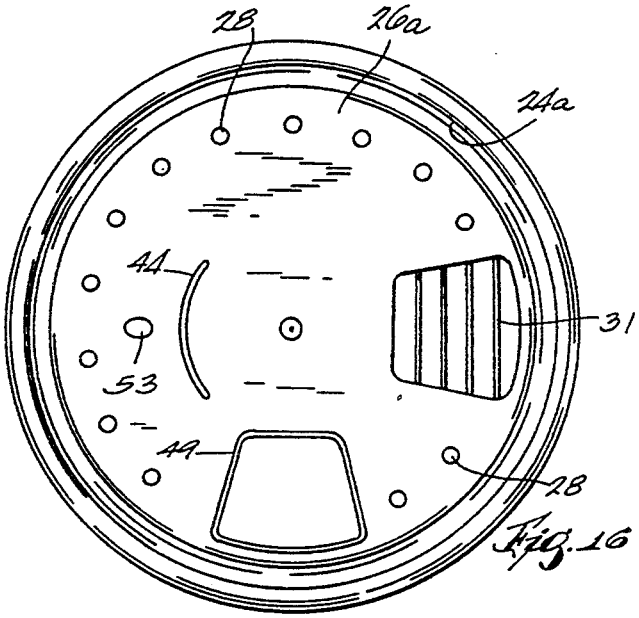
FIG. 16 is a top plan view of the lid shown in FIG. 14.
Figure 17:
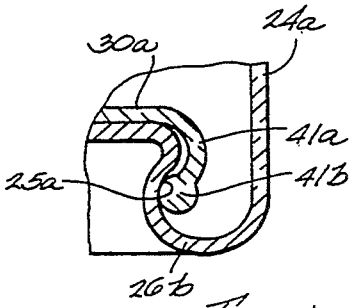
FIG. 17 is an enlarged localized view, in cross-section, of a portion of the rim of the cover and the groove of the lid, showing the interengagement of lid and cover to provide fluid-tight seal under pressure.

In FIGS. 13 and 14 there is shown a groove 25-*a* which is disposed around the periphery of the lid 24-*a* in such a manner as to form a vertical wall with a concave depression which faces generally radially outwardly from the center of the container. Thus the flat surface 26-*a* of the lid is raised above that portion 26-*b* of the lid which is closely adjacent the edge where it is crimped to the container body.

The cover 30-*a* has at its outer edge a curved portion 40-*a* which bends downwardly to form a rim 41-*a* which may have a bead 41-*b* at the edge. This bead 41-*b* (or the rim 41-*a*) rests in the concave depression, as shown in FIG. 13, to form a fluid tight seal between lid and cover.

Because of the interrelation of bead and groove, rotation of the cover with respect to the lid is possible even when the contents of the container are under pressure. In fact, with increased pressure in the container, the seal improves so that pressures as high as 90 psi or more are possible without leaking of the contents from the container.

In other respects, the embodiment of FIGS. 13–17 operates and performs as described with respect to the embodiment shown in FIGS. 1–12.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. A closure assembly for disposable metal beverage containers, said assembly including a non-rotatable lid with an opening, a rotatable cover with an opening, said cover pivotally secured to said lid so that said openings may selectively be aligned or separated, grid bars across each of said openings with the grid bars in said cover disposed at an angle to the grid bars in said lid to provide a screen when the openings are aligned, a guide-slot in said lid and a projection in said cover which can move in said guide-slot when said cover is pivotally rotated with respect to said lid, and a tamper-evident bellows in said cover rendered collapsible by a portion of said lid when said cover is rotated with respect to said lid, said lid including a radially-extending groove closely adjacent the periphery of said lid, a rim on said cover, said rim having an in-turned edge disposed in said radially-extending groove.

2. The beverage container of claim 1 wherein the in-turned edge of said rim includes a bead which rests in said radially-extending groove.

3. The beverage container of claim 1 which is constructed to contain fluid under pressure and wherein the in-turned edge, in cooperation with the radially-extending groove, creates a fluid-tight seal between said lid and said cover.

4. The beverage container of claim 3 wherein the fluid-tight seal can withstand pressure in the container which exceeds 70 psi.

5. The beverage container of claim 3 wherein the fluid-tight seal can withstand pressure in the container which exceeds 90 psi.

* * * * *